US006604327B1

(12) United States Patent
Reville

(10) Patent No.: US 6,604,327 B1
(45) Date of Patent: Aug. 12, 2003

(54) RETRACTABLE SPA ENCLOSURE

(75) Inventor: Jim Reville, Jamestown, CA (US)

(73) Assignee: Ameracover Pool Enclosures, Inc., Jamestown, CA (US)

( * ) Notice: Subject to any disclaimer, the term of this patent is extended or adjusted under 35 U.S.C. 154(b) by 0 days.

(21) Appl. No.: 10/004,169

(22) Filed: Oct. 30, 2001

(51) Int. Cl.[7] ..... E04B 7/16; E05D 15/58

(52) U.S. Cl. ..... 52/64; 52/67; 52/69; 49/258; 49/260

(58) Field of Search ..... 52/64, 67, 69, 52/71, 730.3, 730.4, 732.1, 86, DIG. 17; 49/125, 254, 257, 258, 260

(56) References Cited

U.S. PATENT DOCUMENTS 1,188,482 A * 6/1916 Phillips ..... 16/104
1,961,006 A * 5/1934 Marty ..... 52/800.16
3,107,400 A * 10/1963 Anderson ..... 52/69
3,226,890 A * 1/1966 Flajole ..... 52/66
4,089,135 A * 5/1978 Beny et al. ..... 49/257
4,344,252 A * 8/1982 Suzuki et al. ..... 49/199
4,388,778 A * 6/1983 Brooke ..... 49/125
4,603,643 A * 8/1986 Couvrette ..... 109/24.1
4,711,257 A * 12/1987 Kobayashi ..... 134/56 R
4,796,395 A * 1/1989 Israel ..... 52/86
4,869,030 A * 9/1989 Clark ..... 52/79.6
4,905,542 A * 3/1990 Burm et al. ..... 74/625
5,145,744 A * 9/1992 Cartier et al. ..... 428/423.7
5,239,776 A * 8/1993 Lhotak ..... 49/199
5,444,944 A * 8/1995 Roelofsz ..... 52/64
5,615,623 A * 4/1997 Capraro, Jr. ..... 109/2
5,634,683 A * 6/1997 Young ..... 296/165
5,706,616 A * 1/1998 Fernandez ..... 52/143
5,765,316 A * 6/1998 Kavarsky ..... 52/67
6,243,992 B1 * 6/2001 Gyllenhammar ..... 52/64
6,257,638 B1 * 7/2001 Graber ..... 296/26.09

* cited by examiner

*Primary Examiner*—Carl D. Friedman
*Assistant Examiner*—Kevin McDermott
(74) *Attorney, Agent, or Firm*—The Kline Law Firm

(57) ABSTRACT

A retractable trackless spa enclosure includes at least two sections, a first section being slightly smaller than a second section. The first section may be retracted into the second section in reverse telescoping fashion. Both sections are mounted on wheels so that the spa may be more easily moved. Both sections of the enclosure may also include a sliding door for access/egress. In addition, the front end panel of the front section is pivotally mounted on rollers that move within a track. The pivotal mounting allows the front end panel to be rotated in its frame, so that it can be moved to a position horizontal to the ground, thereby providing sufficient clearance for the enclosure to pass over the spa. When the enclosure is retracted, the front end panel can be moved to a position adjacent the end wall of the rear section, so that an open-ended alcove is formed. The frame of the structure is formed from extruded aluminum, and is therefore very lightweight. The roof utilizes unique purlins that enable the roof to meet snow load requirements with a minimum of material. The panels inserted into the frame will typically be clear plastic.

31 Claims, 11 Drawing Sheets

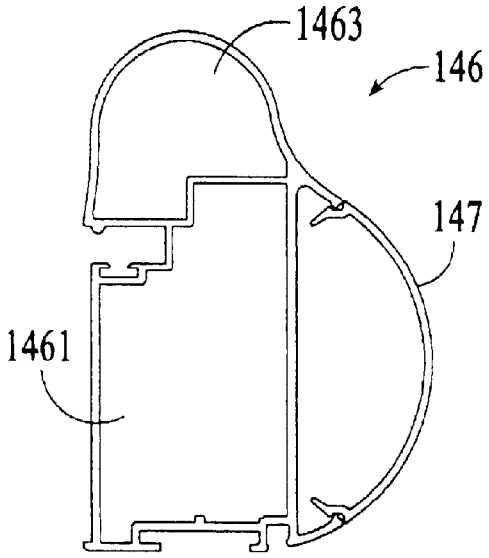
FIG. 14
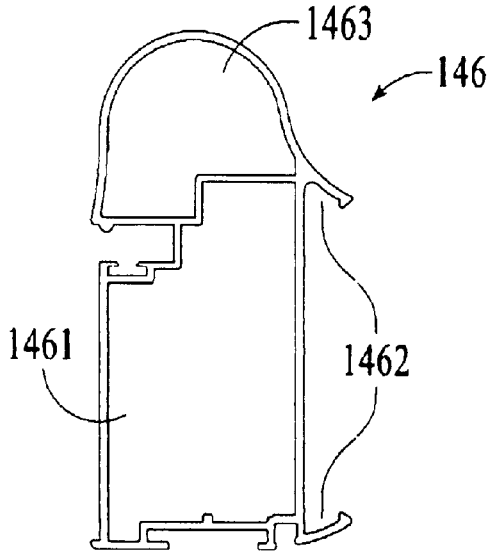
FIG. 15
FIG. 16
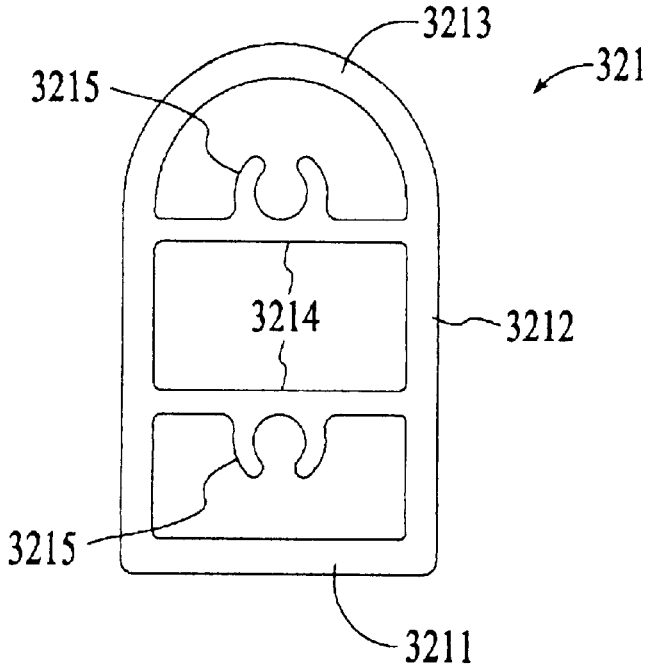

RETRACTABLE SPA ENCLOSURE

BACKGROUND OF THE INVENTION

1. Field of the Invention

The present invention relates generally to spa enclosures and covers, and more particularly is a retractable spa enclosure that operates without wheel tracks.

2. Description of the Prior Art

There are many devices in the prior art directed to the covering or enclosing of spas. Many of the devices are for decorative purposes only, but most are also directed to making the spa more efficient and enjoyable to use, and to extending the time of the year during which the spa can be comfortably used.

One of the most simple devices used with spas is a cover that helps to maintain water temperature and reduce water loss due to evaporation in the spa. While a cover does improve efficiency, the cover does little to shield the users from the elements, as the cover must of course be removed before using the spa.

One commonly used structure for spas that does provide a small measure of protection from weather is a wooden gazebo. The main function of the gazebo is to improve appearances, and the structure does provide some shade. But while the gazebo is aesthetically pleasing, and is able to provide some shelter for the users of the spa, a gazebo, like any other wooden structure, is subject to decay and dry rot that will ultimately result in a loss of structural integrity.

For these reasons, spa users have considered enclosures that are greenhouse-like in construction. Using clear plastic or glass, these enclosures can completely enclose the spa and increase the temperature inside the enclosure considerably. While this is advantageous at the beginning and the end of the spa use season, it can be quite uncomfortable during hot summer weather. Because of their generally rigid construction, greenhouse-like spa enclosures must be permanently installed, and are thereby limited in their usefulness.

Accordingly, it is an object of the present invention to provide a spa enclosure that can completely enclose the spa area, and that need not be made from wood.

It is another object of the present invention to provide a spa enclosure that is retractable so that the spa enclosure can be opened during hot weather.

It is a further object of the present invention to provide a retractable enclosure that operates without installed tracks for the retraction wheels.

It is a still further object of the present invention to provide an enclosure with a front wall that may be moved in an upright position, and may be rotated to a position parallel to the ground.

SUMMARY OF THE INVENTION

The present invention is a retractable spa enclosure. The enclosure comprises at least two sections, a first section being slightly smaller than a second section. The first section may be retracted into the second section in reverse telescoping fashion. Both sections are mounted on wheels so that the spa may be more easily moved, the movement of the sections not requiring any tracks.

Both sections of the enclosure may include a sliding door for access/egress. In addition, the front end panel of the front section is pivotally mounted on rollers that move within a track. The pivotal mounting allows the front end panel to be rotated in its frame, so that it can be moved to a position horizontal to the ground, thereby providing sufficient clearance for the enclosure to pass over the spa. When the enclosure is retracted, the front end panel can be moved to a position adjacent the end wall of the rear section, so that an open-ended alcove is formed.

The frame of the structure is formed from extruded aluminum, and is therefore very lightweight. The roof utilizes unique purlins that enable the roof to meet snow load requirements with a minimum of material. The panels inserted into the frame will typically be clear plastic.

While it should be recognized that many different shapes will serve equally well for the present invention, in the preferred embodiment, the enclosure has a rectangular base with a gambrel roof. The gambrel roof was chosen both for appearance and for structural considerations, e.g. sustainable snow load. The tapered shape of the gambrel roof also tends to more readily shed water, debris, and snow.

An advantage of the present invention is that it produces a shelter that provides maximum protection and warmth to the users, while being easily retractable so that the spa is still comfortably used in hot weather.

Another advantage of the present invention is that it completely covers the spa to provide maximum protection.

A still further advantage of the present invention is that it is inexpensive and easy to manufacture in comparison to prior art alternatives.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 14 is a cross section of the element used to construct the rear section frame.

FIG. 15 is a sectional view of the rear section frame with the cover affixed.

FIG. 16 is a section view of the purlin used to construct the roof frame.

DETAILED DESCRIPTION OF THE INVENTION

Figure 1:
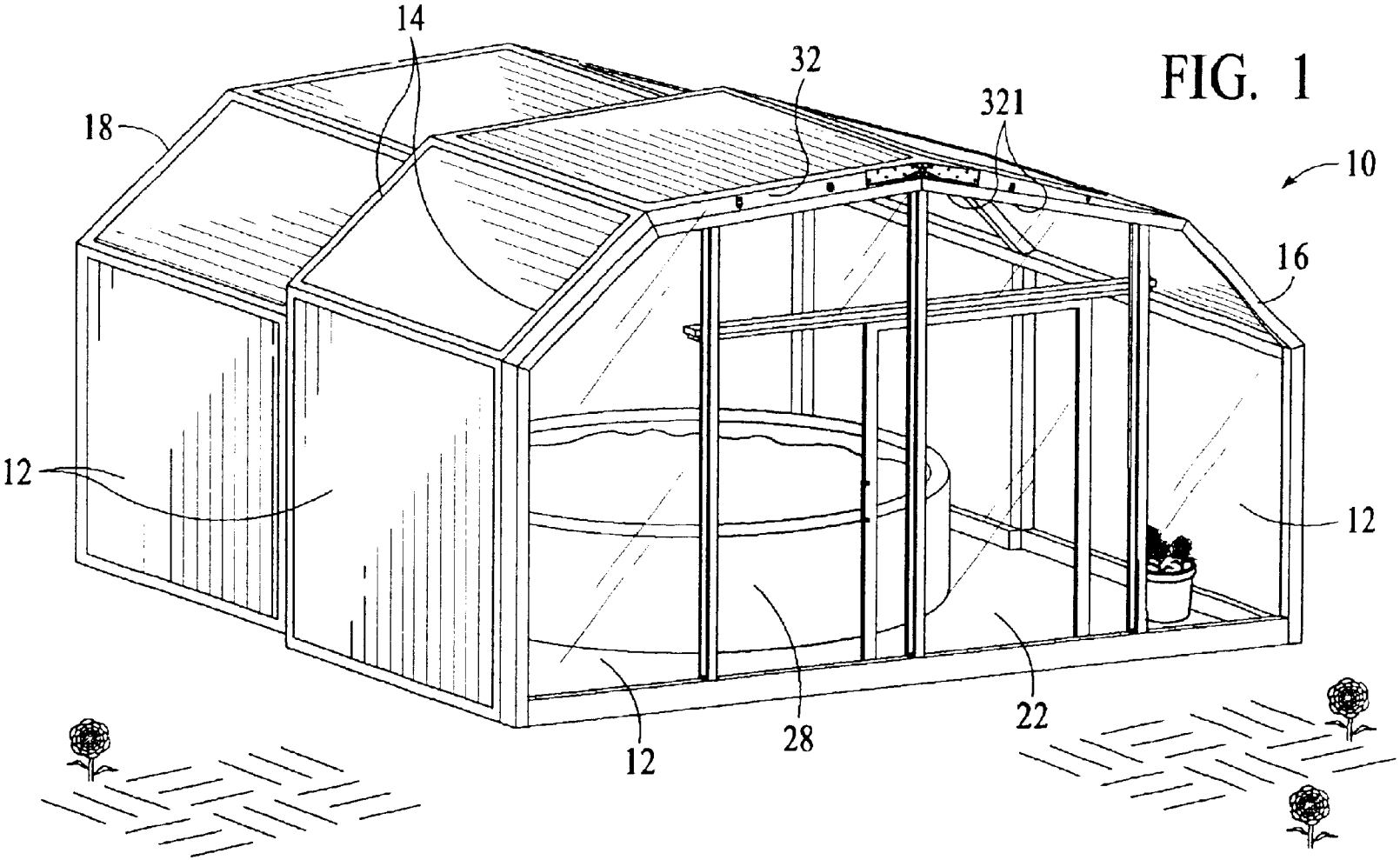
FIG. 1 is a perspective view of the spa enclosure in the fully open position.

Referring first to FIGS. 1–5, the present invention is a retractable trackless spa enclosure 10. The spa enclosure 10 is constructed with a plurality of insert panels 12 mounted in a frame 14. The frame 14 comprises multiple elements joined by connecting members and supporting struts. The elements of the frame 14 include slots 144 to receive the insert panels 12. In the preferred embodiment, the frame 14 is constructed of lightweight extruded aluminum. The insert panels 12 will typically be formed from a see-through material, such as plastic or glass.

The spa enclosure 10 comprises at least two sections, a front section 16 and a rear section 18. The front section 16 is constructed so as to be slightly smaller than the rear section 18. That is, the exterior perimeter of the front section 16 is slightly smaller in width and height than the internal perimeter of the rear section 18. This enables the front section 16 to nest into the rear section 18 when the enclosure 10 is in a retracted position. (See FIG. 3.) Both the front section 16 and the rear section 18 are mounted on wheels 20 so as to make the spa enclosure 10 more easily moveable. In practice, when the enclosure 10 is installed at the desired locations, anchor means will be affixed to the corners of the sections 16, 18 to secure the enclosure 10 in position.

Both of the sections 16, 18 include a door 22 for access into and egress from the enclosure 10. The doors 22 will typically be sliding glass or plastic doors mounted in the front and rear sides of the front and rear sections 16, 18.

The nesting and sliding functions of the front and rear sections 16, 18 are optimized by using different frame elements—a minor frame element 145 for the front section 16 and a major frame element 146 for the rear section 18. Cross sectional views of the frame elements 145, 146 are shown in FIGS. 11–15. The minor frame 145 comprises a main frame body 1451, a cover slot 1452, a rounded peak 1453, and a stop tab 1454. The slot 1452 receives a rounded snap-on cover 147 that gives the constructed frame 14 a more aesthetically pleasing appearance. The stop tab 1454 is employed in the sliding function of the cover 10 described in further detail below. Major frame 146, as does the minor frame 145, comprises a main frame body 1461, a cover slot 1462, and a rounded peak 1463. The same snap-on cover 147 is used for both the major and minor frame elements 145,146.

Figure 8:
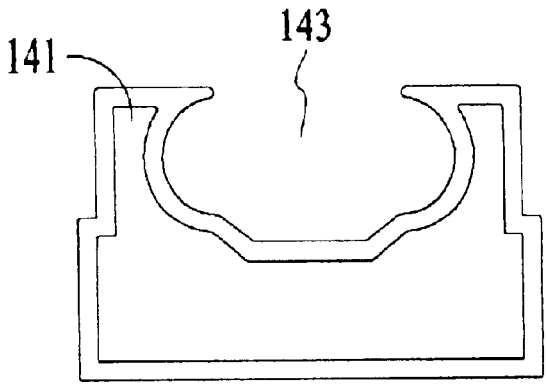
FIG. 8 is a cross section of the slide frame.
Figure 9:
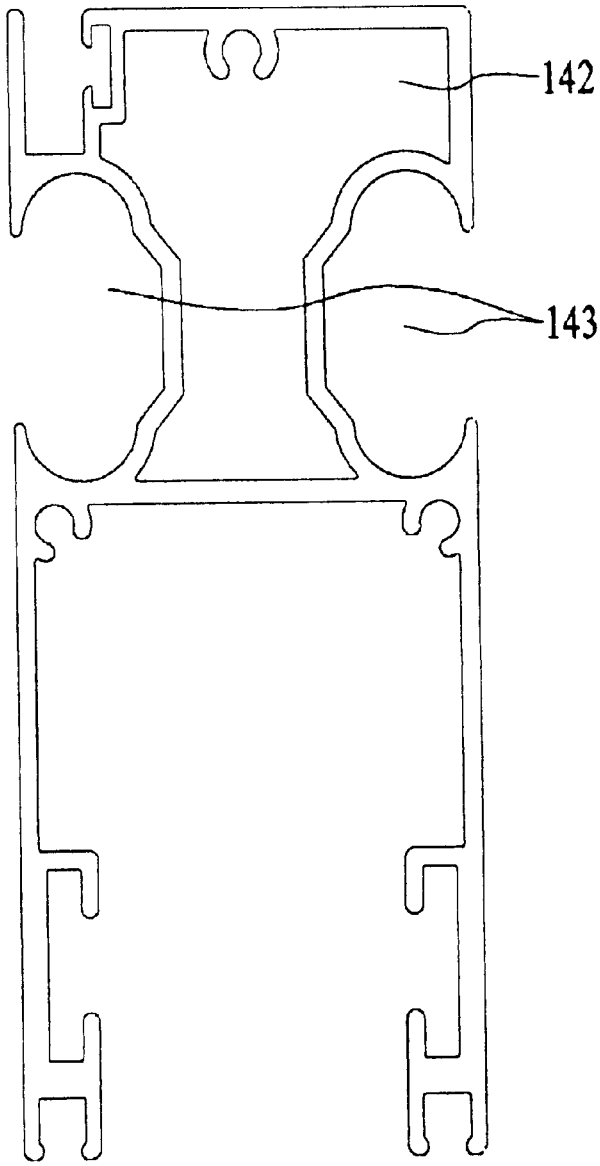
FIG. 9 is a cross section of a connection strut.
Figure 10:
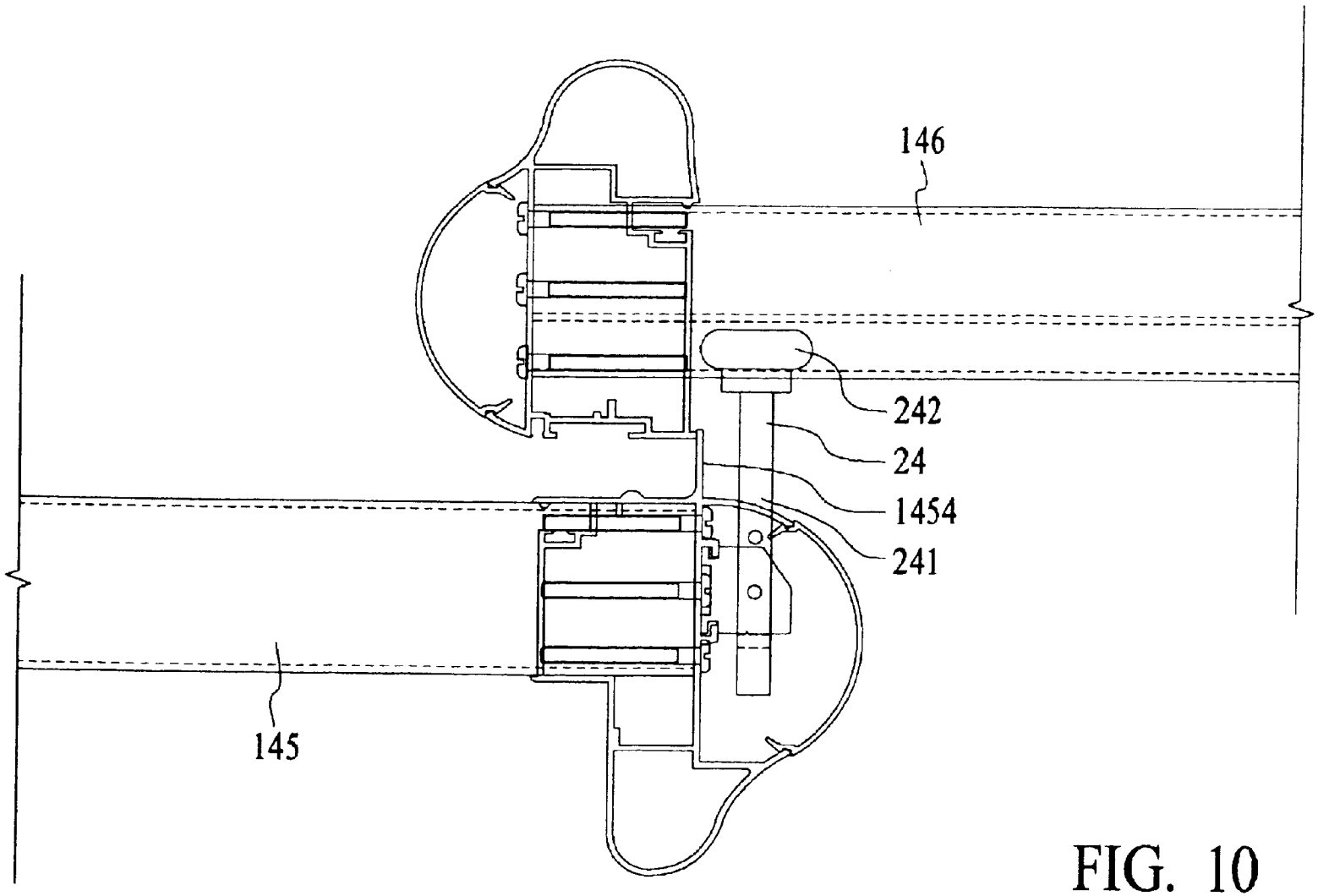
FIG. 10 is a cross section of a section alignment assembly.
Figure 11:
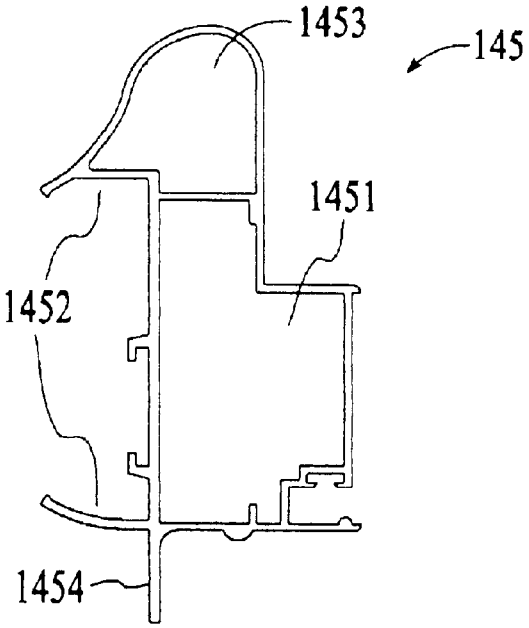
FIG. 11 is a cross section of the element used to construct the front section frame.
Figure 12:
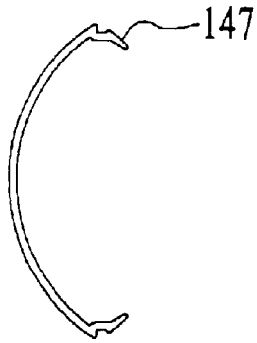
FIG. 12 is a sectional view of a snap-on cover element.
Figure 13:
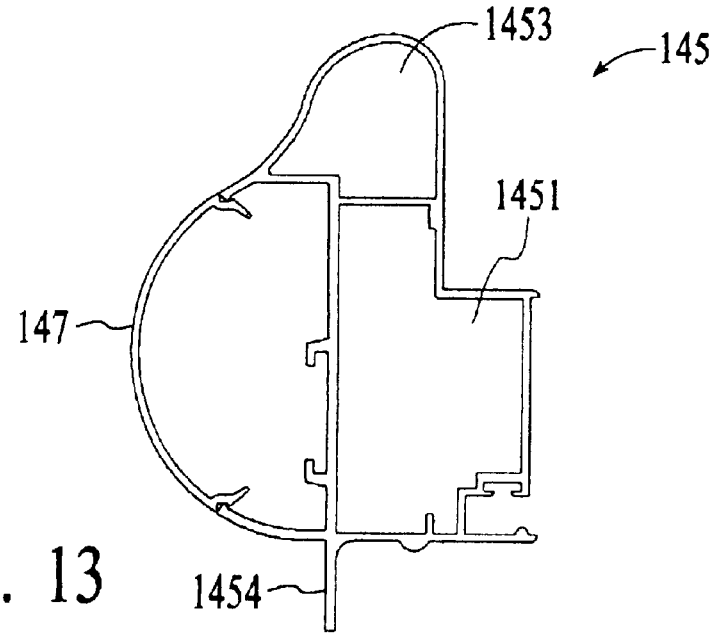
FIG. 13 is a sectional view of the front section frame with the cover affixed.

Please refer now to FIGS. 8–10, which illustrate the elements that facilitate the alignment and the motion of the sections 16, 18, relative to each other. The frame 14 includes side members on the sides of the sections 16, 18 that are equipped with slide frame 141 elements (FIG. 8) that receive section alignment assemblies 24 (FIG. 10). The terminal ends of the lower side sections of the frame 14, and anywhere else that a user chooses to mount wheels 20, require connection struts 142 (FIG. 9). The connection struts 142 serve as a wheel mount means and also receive an alignment assembly 24 or a door roller.

The slide frames 141 and the connection struts 142 include a roller channel 143. The section alignment assemblies 24 comprise a rod 241 with a first end fixedly secured in a first section of the frame 14. A second end of the rod 241 includes a roller 242 that is movably received in the channel 143 of a second section of the frame 14. In this way a movable alignment joint is formed to hold the front section 16 in proper alignment with the rear section 18. As the front section 16 is moved relative to the rear section 18, the rollers 242 of the section alignment assemblies 24 move within the channels 143 of the frame 14. When the sections 16, 18 are fully extended, the stop tab 1454 of the minor frame 145 contacts the main frame body 1461 of the main frame, thereby preventing the two sections 16, 18 from separating. This position is depicted in FIG. 10.

An entire front wall 161 of the front section 16 of the enclosure 10 is pivotally mounted in a wall track 26 that is mounted on the frame 14. The wall track 26 is shown in some detail in FIGS. 4–7. In the preferred embodiment, the wall track 26 comprises upper and lower horizontal channel sections 261, and front and rear vertical channel sections 262. Because of the length of the horizontal sections 261, a vertical support bar 263 is placed at a midpoint of the horizontal sections 261 of the track 26. The support bar 263 braces the wall track 26 so that the track 26 can stably support the weight of the front wall 161.

Figure 2:
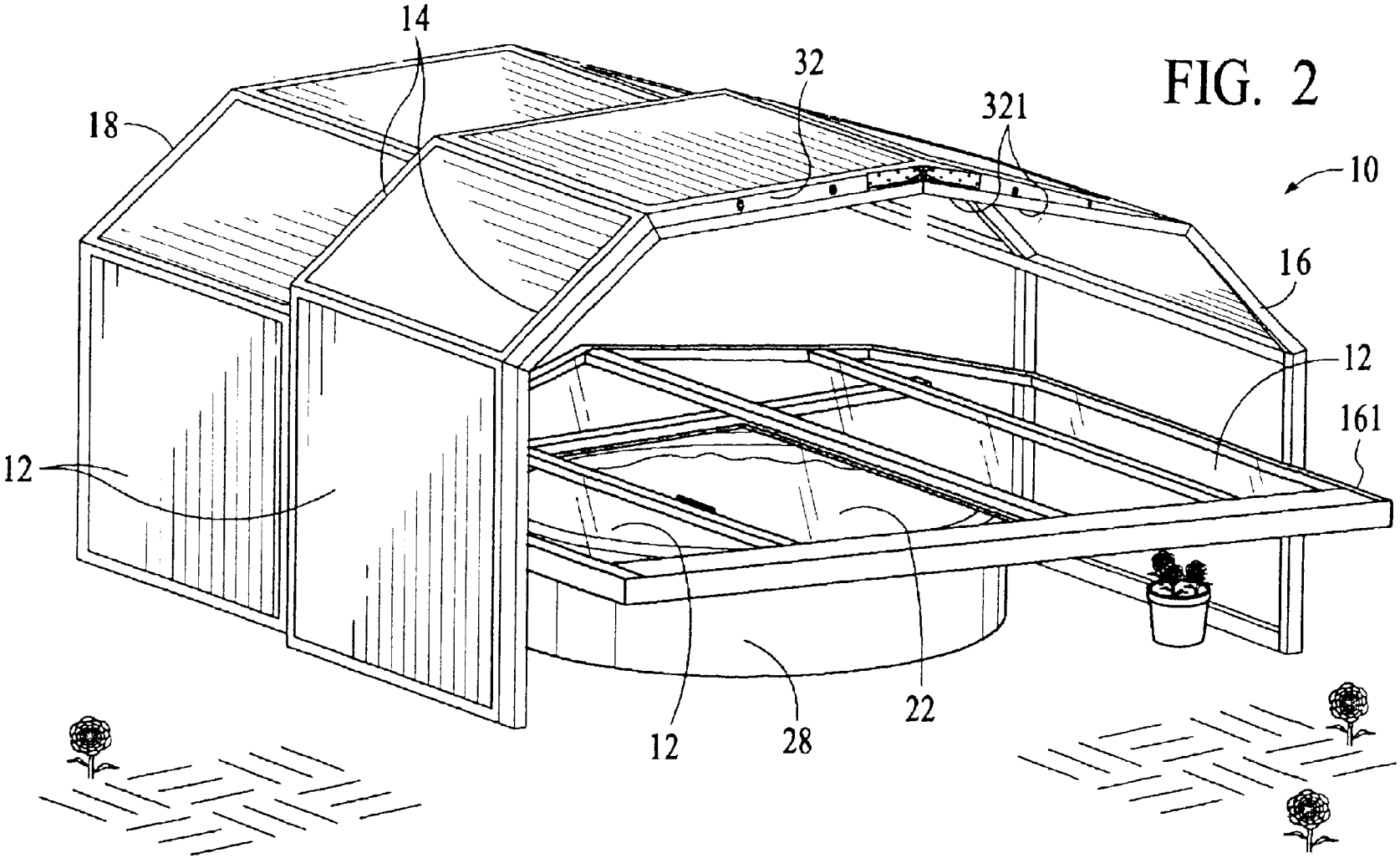
FIG. 2 is a perspective view of the spa enclosure with the front wall rotated to a horizontal position.
Figure 3:
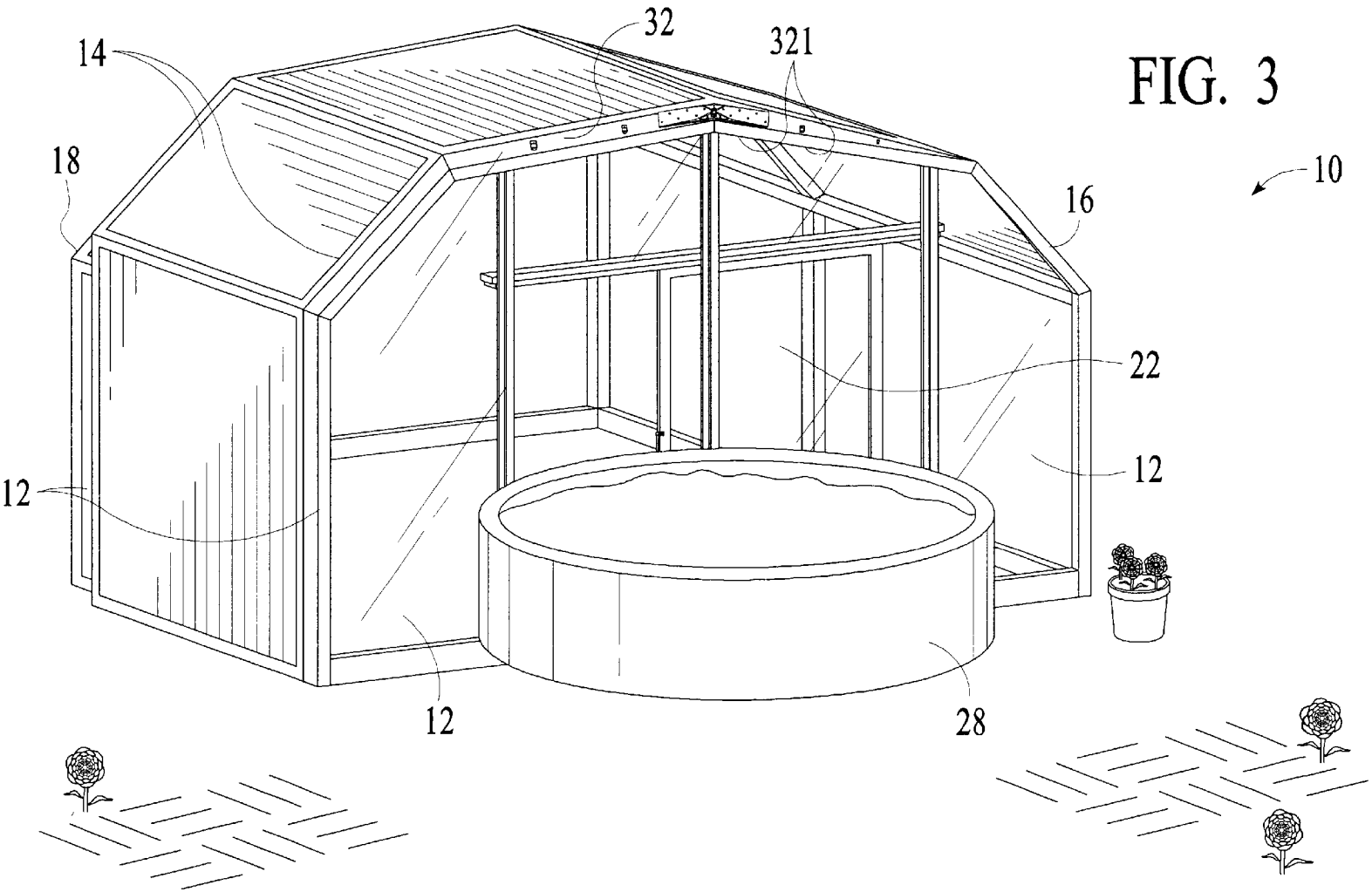
FIG. 3 is a perspective view of the spa enclosure in the retracted position.
Figure 4:
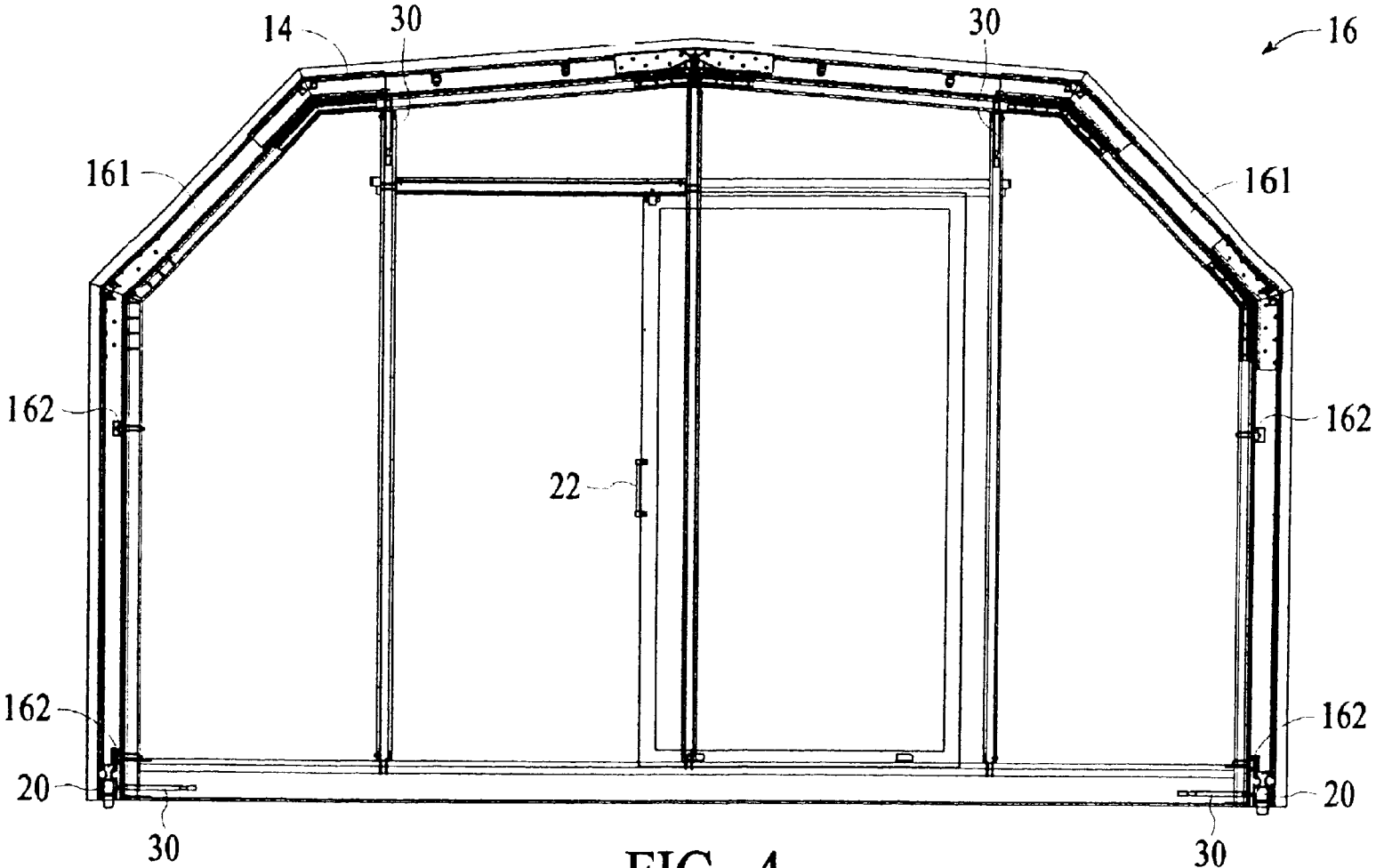
FIG. 4 is a front view of the front section.
Figure 5:
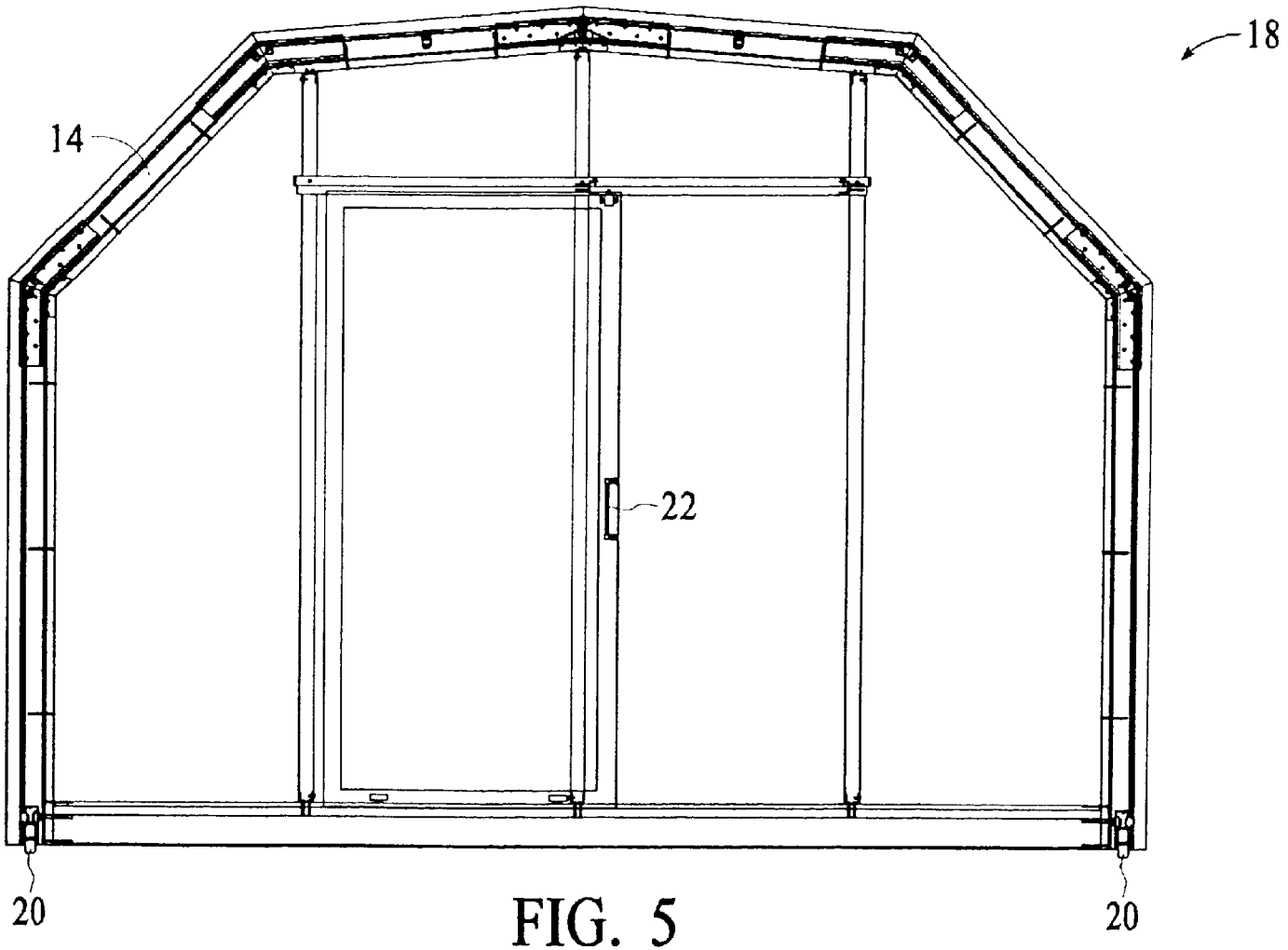
FIG. 5 is a rear view of the rear section.
Figure 6:
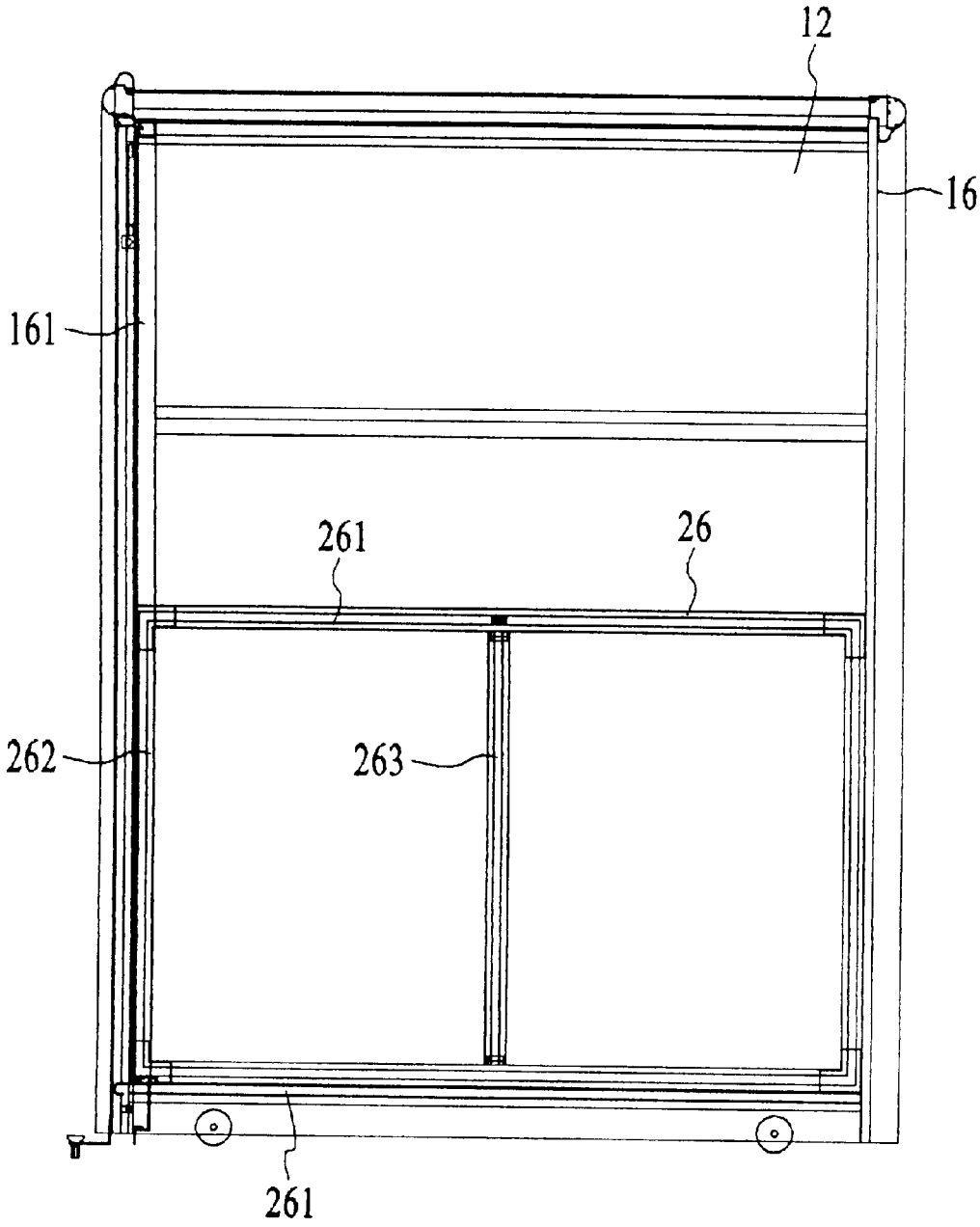
FIG. 6 is a side view of the front section showing the door track.
Figure 7:
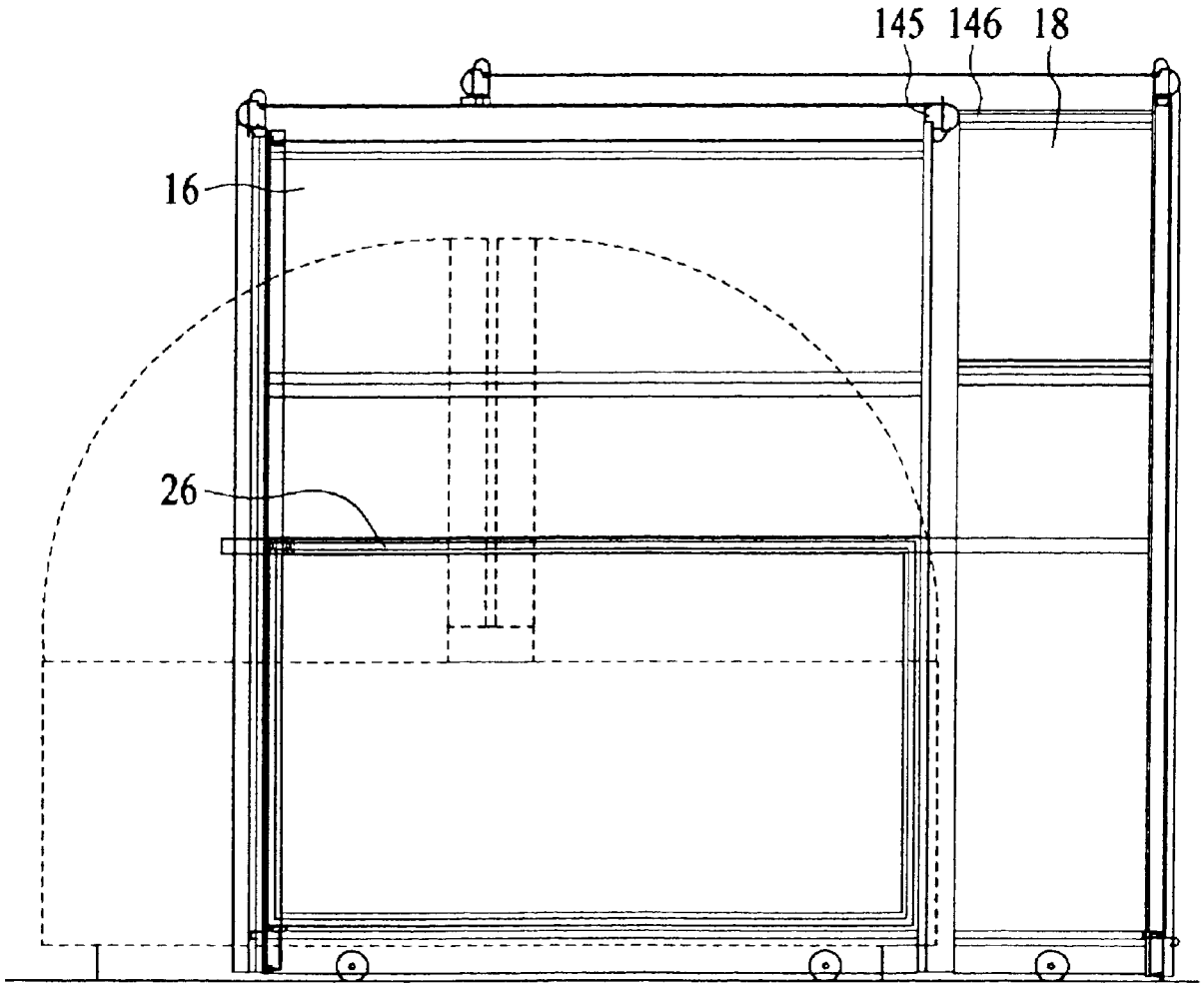
FIG. 7 is a side view of the nested sections.

The front wall 161 is mounted in the wall track 26 by means of wall rollers 162 installed in the wall track 26. In the preferred embodiment, there is at least a pair of lower rollers 162 that are mounted at a lower edge of the wall 161 and received in the lower horizontal channel sections 261, and a pair of upper rollers 162 that are mounted at the midpoint of the wall 161 and received in the upper horizontal channel sections 261. An axle of each of the rollers 162 is affixed to the front wall 161. This configuration enables a user to slide the front wall 161 from the front of the front section 16 to the rear of the front section 16, and to rotate the front wall 161 from a vertical position (FIG. 1) to a lowered horizontal position (FIG. 2). Rotating the front wall 161 to the horizontal position enables the wall 161 to clear the spa 28, which is in almost every installation at least slightly elevated, when the enclosure 10 is being retracted. When the user slides the wall 161 from front to back, all the rollers 162 travel along the horizontal channel sections 261. When the front wall 161 is pivoted, the lower rollers 162 move up and down the vertical channel sections 262. Containing the rollers 162 in the track 26 during the pivoting of the wall 161 allows the user to maintain control of the wall 161 more easily, so that the wall 161 does not present a threat to the user's shins during the pivoting operation.

At least one latching mechanism 30 is provided between the front wall 161 and the frame 14 to lock the front wall 161 in place when it is in the upright position. In the preferred embodiment, four spring-loaded slam latches are used in the latching mechanism 30. The latches 30 can of course be placed anywhere within the travel range of the front wall 161 in the track 26 that the user desires to secure the wall 161 in the upright position. Latches 30 will at least be provided at a front side of the front section 16 since that is the position of the front wall 161 when the enclosure is deployed.

Referring now to FIG. 16, the enclosure 10 in the preferred embodiment has a gambrel roof 32. The gambrel roof 32 utilizes unique purlins 321 as supporting elements. The purlins 321 enable the roof 32 to meet snow load requirements while using a minimum of material. The purlins 321 have a flat bottom wall 3211, flat side walls 3212, and a rounded top side 3213. The purlins 321 derive their unique strength in part from a pair of lateral interior support bars 3214. The interior support bars 3214 extend for the length of the purlins 321. On a top side of the upper support bar 3214 and on a bottom side of the lower support bar 3214 are arced screw mounts 3215. The screw mounts 3215 are provided to make attachment of the purlins 321 to the walls of the frame 14 a simple matter.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A retractable enclosure comprising:

at least a first section and a second section, said first section and said second section comprising a frame formed from a plurality of frame elements, a plurality of panels received in said frame elements, at least one door for access into and egress from said enclosure, and wheels affixed to said frame of at least one of said sections; wherein said first section is smaller than said second section, so that when said enclosure is moved to a retracted position, said first section is received in an interior of said second section, and a front wall of said first section of said enclosure is pivotally and slidably mounted in a wall track mounted on said frame, such that said front wall pivots from a vertical position to a horizontal position, and said front wall is positionable in said vertical position at any point along a length of said wall track.

2. The enclosure of claim 1, wherein:

said wall track comprises upper and lower horizontal channel sections, and front and rear vertical channel sections, said channel sections each comprising means for securing a plurality of rollers in said channel sections, each said roller having an axle secured to said front wall; such that a pair of said rollers mounted in said lower horizontal sections travels up a front side of said vertical channel sections when said front wall is pivoted from said vertical position to a horizontal position, and said pair of said rollers slides from a front end of said front section to a rear end of said front section.

3. The enclosure of claim 1, wherein:

said frame includes side members on sides of said first section and said second section, said side members have affixed thereto slide frame elements that receive at least one section alignment assembly, said section alignment assemblies each comprise a rod with a first end fixedly secured in a first section of said frame, a second end of said rod includes a roller movably received in a channel of a second section of said frame, said section alignment assemblies forming movable alignment joints that hold said first section in proper alignment with said second section; wherein as said first section is moved relative to said second section, said rollers of said section alignment assemblies move within said channels of said frame.

4. The enclosure of claim 1, wherein:

at least one door is included in said first section or said second section.

5. The enclosure of claim 1, wherein:

at least one purlin of a roof of said enclosure comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

6. The enclosure of claim 1, wherein:

said frame elements are formed from extruded aluminum.

7. The enclosure of claim 1, wherein:

said panels are formed from clear plastic.

8. A retractable enclosure comprising:

at least a first section and a second section, said first section and said second section comprising a frame formed from a plurality of frame elements, a plurality of panels received in said frame elements, at least one door for access into and egress from said enclosure; wherein said first section is smaller than said second section, so that when said enclosure is moved to a retracted position, said first section is received in an interior of said second section, and a front wall of said first section of said enclosure is pivotally and slidably mounted in a wall track mounted on said frame, such that said front wall pivots from a vertical position to a horizontal position, and said front wall is positionable in said vertical position at any point along a length of said wall track.

9. The enclosure of claim 8, wherein:

said wall track comprises upper and lower horizontal channel sections, and front and rear vertical channel sections, said channel sections each comprising means for securing a plurality of rollers in said channel sections, each said roller having an axle secured to said front wall; such that a pair of said rollers mounted in said lower horizontal sections travels up a front side of said vertical channel sections when said front wall is pivoted from said vertical position to a horizontal position, and said pair of said rollers slides from a front end of said front section to a rear end of said front section.

10. The enclosure of claim 8, wherein:

wheels are affixed to a frame of at least said first section to enable said first section to easily move into said second section when said enclosure is moved to said retracted position.

11. The enclosure of claim 8, wherein:

said frame includes side members on sides of said first section and said second section, said side members have affixed thereto slide frame elements that receive at least one section alignment assembly, said section alignment assemblies each comprise a rod with a first end fixedly secured in a first section of said frame, a second end of said rod includes a roller movably received in a channel of a second section of said frame, said section alignment assemblies forming movable alignment joints that hold said first section in proper alignment with said second section; wherein as said first section is moved relative to said second section, said rollers of said section alignment assemblies move within said channels of said frame.

12. The enclosure of claim 8, wherein:

at least one door is included in said first section or said second section.

13. The enclosure of claims 8, wherein:

at least one purlin of a roof of said enclosure comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

14. The enclosure of claim 8, wherein:

said frame elements are formed from extruded aluminum.

15. The enclosure of claim 8, wherein: said panels are formed from clear plastic.

16. A retractable enclosure comprising:

at least a first section and a second section, said first section and said second section comprising a frame formed from a plurality of frame elements, a plurality of panels received in said frame elements, at least one door for access into and egress from said enclosure, and wheels affixed to a frame of at least said first section; wherein said first section is smaller than said second section, so that when said enclosure is moved to a retracted position, said first section is received in an interior of said second section, and said frame includes side members on sides of said first section and said second section, said side members have affixed thereto slide frame elements that receive at least two section alignment assemblies, said section alignment assemblies comprise a rod with a first end fixedly secured in a first section of said frame, a second end of said rod includes a roller movably received in a channel of a second section of said frame, said section alignment assemblies forming movable alignment joints that hold said first section in proper alignment with said second section; wherein as said first section is moved relative to said second section, said rollers of said section alignment assemblies move within said channels of said frame.

17. The enclosure of claim 16, wherein:

at least one door is included in said first section or said second section.

18. The enclosure of claim 16, wherein:

at least one purlin of a roof comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

19. The enclosure of claim 16, wherein:

said frame elements are formed from extruded aluminum.

20. The enclosure of claim 16, wherein:

said panels are formed from clear plastic.

21. A retractable enclosure comprising:

at least a first section and a second section, said first section and said second section comprising a frame formed from a plurality of frame elements, a plurality of panels received in said frame elements, at least one door for access into and egress from said enclosure, and wheels affixed to a frame of at least said first section; wherein said first section is smaller than said second section, so that when said enclosure is moved to a retracted position, said first section is received in an interior of said second section, and at least one purlin of a roof comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

22. The enclosure of claim 21, wherein:

said frame elements are formed from extruded aluminum.

23. The enclosure of claim 21, wherein:

said panels are formed from clear plastic.

24. A retractable enclosure comprising:

at least a first section and a second section, said first section and said second section comprising a frame formed from a plurality of frame elements, a plurality of panels received in said frame elements, at least one door for access into and egress from said enclosure; wherein said first section is smaller than said second section, so that when said enclosure is moved to a retracted position, said first section is received in an interior of said second section, and said frame includes side members on sides of said first section and said second section, said side members have affixed thereto slide frame elements that receive at least two section alignment assemblies, said section alignment assemblies comprise a rod with a first end fixedly secured in a first section of said frame, a second end of said rod includes a roller movably received in a channel of a second section of said frame, said section alignment assemblies forming movable alignment joints that hold said first section in proper alignment with said second section, so that as said first section is moved relative to said second section, said rollers of said section alignment assemblies move within said channels of said frame.

25. The enclosure of claim 24, wherein:

at least one door is included in said first section or said second section.

26. The enclosure of claim 24, wherein:

at least one purlin of a roof comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

27. The enclosure of claim 24, wherein:

said frame elements are formed from extruded aluminum.

28. The enclosure of claim 24, wherein:

said panels are formed from clear plastic.

29. A retractable enclosure comprising:

at least a first section and a second section, said first section and said second section comprising a frame formed from a plurality of frame elements, a plurality of panels received in said frame elements, at least one door for access into and egress from said enclosure; wherein said first section is smaller than said second section, so that when said enclosure is moved to a retracted position, said first section is received in an interior of said second section, and at least one purlin of a roof comprises a bottom wall, two side walls, a rounded top side, and an upper interior support bar, and a lower interior support bar, each said interior support bar extending for a length of said purlins; wherein on a top side of said upper interior support bar and on a bottom side of said lower interior support bar are arced screw mounts.

30. The enclosure of claim 29, wherein:

said frame elements are formed from extruded aluminum.

31. The enclosure of claim 29, wherein:

said panels are formed from clear plastic.

* * * * *